US007736523B2

(12) United States Patent
King

(10) Patent No.: US 7,736,523 B2
(45) Date of Patent: Jun. 15, 2010

(54) ATTACHMENT FOR UNDERWATER SURFACE CLEANER

(75) Inventor: Joseph A. King, Wayzata, MN (US)

(73) Assignee: King Technology Inc, Hopkins, MN (US)

( * ) Notice: Subject to any disclaimer, the term of this patent is extended or adjusted under 35 U.S.C. 154(b) by 217 days.

(21) Appl. No.: 12/070,199

(22) Filed: Feb. 15, 2008

(65) Prior Publication Data

US 2008/0237103 A1 Oct. 2, 2008

Related U.S. Application Data

(60) Provisional application No. 60/920,547, filed on Mar. 28, 2007.

(51) Int. Cl.
*C02F 1/50* (2006.01)
*C02F 1/76* (2006.01)
*E04H 4/16* (2006.01)

(52) U.S. Cl. ..... 210/749; 210/167.11; 210/167.16; 210/416.2; 15/1.7

(58) Field of Classification Search ..... 210/749, 210/753–756, 167.1, 167.11, 167.15, 167.16, 210/167.17, 416.1, 416.2; 15/1.7
See application file for complete search history.

(56) References Cited

U.S. PATENT DOCUMENTS 3,684,460 A * 8/1972 Arneson ..... 422/265
4,429,429 A * 2/1984 Altschul ..... 15/50.1
4,575,423 A * 3/1986 Alanis et al. ..... 210/167.17
4,589,986 A * 5/1986 Greskovics et al. ..... 210/483
5,225,074 A * 7/1993 Moini ..... 210/167.11
5,350,509 A * 9/1994 Nelson ..... 210/198.1
5,882,512 A 3/1999 Denkewicz ..... 210/169
5,976,385 A * 11/1999 King ..... 210/754
6,200,487 B1 3/2001 Denkewicz ..... 210/749
6,221,244 B1 * 4/2001 Yassin ..... 210/167.11
6,358,425 B1 * 3/2002 King ..... 210/764
6,423,217 B1 7/2002 Campbell ..... 210/69
6,601,255 B1 8/2003 Johannes ..... 15/1.7
6,792,956 B2 * 9/2004 Bredo et al. ..... 134/22.18
6,954,960 B2 10/2005 Pichon ..... 15/1.7
6,979,400 B2 12/2005 Bauckmaan ..... 210/69
7,080,424 B2 7/2006 Kallenbach ..... 15/1.7
D529,669 S 10/2006 Blanc-Tailleur ..... D32/1
7,118,678 B2 10/2006 Porat ..... 210/748

OTHER PUBLICATIONS

Tiger Shark Brochure by AquaVac.

* cited by examiner

*Primary Examiner*—Fred Prince
(74) *Attorney, Agent, or Firm*—Jacobson & Johnson LLC

(57) ABSTRACT

A dispenser or dispensable material for external attachment to a mobile surface cleaning device, mobile surface cleaning device provides an aftermarket apparatus and method for both on-the-go cleaning and on-the-go delivery of dispensable materials into the body of water with the dispensable material mounted either on a downstream side of the mobile surface cleaning device or spaced from the flow path through the mobile surface cleaning device.

16 Claims, 3 Drawing Sheets

ATTACHMENT FOR UNDERWATER SURFACE CLEANER

CROSS REFERENCE TO RELATED APPLICATIONS

This application claims priority from provisional patent application Ser. No. 60/920,547 filed Mar. 28, 2007 titled Attachment for Underwater Surface Cleaner.

FIELD OF THE INVENTION

This invention relates generally to attachments and, more specifically, to dispensing attachments for pool cleaners.

STATEMENT REGARDING FEDERALLY SPONSORED RESEARCH OR DEVELOPMENT

None

REFERENCE TO A MICROFICHE APPENDIX

None

BACKGROUND OF THE INVENTION

It is well known that automatic cleaners operate in a body of water such as a swimming pool. Generally, an electrical powered pool cleaner is connected to an internal or external electrical source, which drives an internal motor that causes the pool cleaner to creep along the bottom of the swimming pool in a pattern that covers the bottom of the pool. Typically, a pool can be cleaned by a mobile pool cleaner in 60 to 90 minutes. Generally, the pool cleaner contains an internal water pump that draws the pool water and the debris off the bottom of the pool and directs the water with the debris through either a cartridge filter and or filter bag to remove and contain the debris from the bottom of the pool. This method of water circulation through the cleaner works in suction or in venturi type devices. In either device the mobile pool cleaner causes the incoming water to follow an internal path through the pool cleaner, which retains the debris, but allows clean water to discharge from the pool cleaner. When the pool cleaning cycle is completed the pool cleaner is removed from the pool and the debris removed from the pool cleaner. U.S. Pat. No. 5,882,512 shows an automatic pool cleaner that contains an internal annular housing, which contains a sanitizing media. The housing with the media as well as the inlet and outlet to the sanitizing media are concealed within the housing thus making it difficult to both determine if fluid is flowing through the sanitizing media as well as to replace the sanitizing media since in order to obtain access or replenish the sanitizing media the pool cleaner needs to be disassembled.

SUMMARY OF THE INVENTION

A dispenser or sanitizer for external attachment to a mobile surface cleaning device, such as a pool cleaner, wherein the mobile surface cleaning device removes debris from a body of water as the mobile surface cleaning device moves about and discharges clean water into the body of water and the dispenser, which may be removeably attached to a housing of the mobile surface cleaning device, provides a method for both on-the-go cleaning and on-the-go delivery of dispensable materials into the body of water with the dispenser or sanitizer mounted either on a downstream side of the mobile surface cleaning device or spaced from the flow path through the mobile surface cleaning device.

DESCRIPTION OF THE PREFERRED EMBODIMENT

Figure 1:
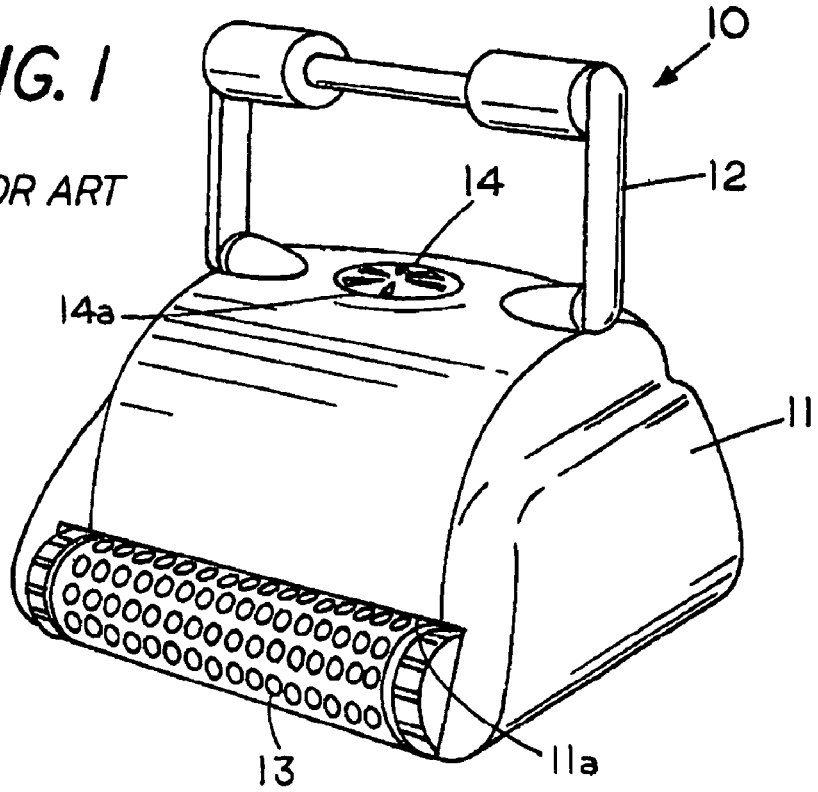
FIG. 1 PRIOR ART
FIG. 1 is a perspective view of a prior art pool cleaner with a top discharge vent.

FIG. 1 is a perspective view of a prior art robot surface pool cleaner or mobile surface cleaning device 10 having a housing 11, with a handle 12 secured thereto, which is sold by Aqua Vac Systems. The mobile surface-cleaning device 10 includes an inlet 11*a* for drawing water into the pool cleaner and outlet ports 14 located in a discharge vent or fitting 14*a* as well as a drive mechanism such as a wheel or cylindrical roller 13 to propel the cleaner 10 along the bottom of the pool. Generally, mobile surface-cleaning devices receive power from an external power source that can be connected to the pool cleaner through a flexible power cord or in some instance the cleaner can contain a rechargeable power source within the housing. The power is used to propel the pool cleaner along the bottom of the pool as well as draw water through the pool cleaner. Examples of automatic pool cleaners that traverse a surface of a pool to remove debris and discharge clean water can be found in U.S. Pat. Nos. D529,669; 6,954,960; 5,882,512 and 7,080,424 which show a pool cleaner with a front roller with a top discharge vent or outlet port.

The commercially available pool cleaners generally discharge the water from the topside of the pool cleaner after the debris or waste particles have been removed by a filter in the pool cleaner. The sanitizing dispenser 30 can be mounted in either the flow path of the clean water discharging from the pool cleaner or the dispenser 30 can be spaced from the flow path of the clean water discharging from the pool cleaner. FIGS. 2-6 show various types of attachments or dispensers that can be mounted directly over the exit port of the pool cleaner and FIG. 7 shows a further embodiment of a sanitizing dispenser, which although secured to the housing is located in a spaced condition from a fluid stream which enters the inlet 11*a* and discharges from the outlet 11*b* of the pool cleaner 60. The embodiment of FIG. 7 allows one to bring a separate stream of pool water through the pool cleaner 60 and a separate stream of pool water through dispenser housing 62. The embodiment of FIG. 7 has the advantage of not placing any fluid resistance on the flow through the pool cleaner since it is the motion of the pool cleaner through the pool water that creates a flow of pool water through the dispensers. It has the further advantage dispensing material from either the sides or the front of the pool cleaner 60.

Figure 2:
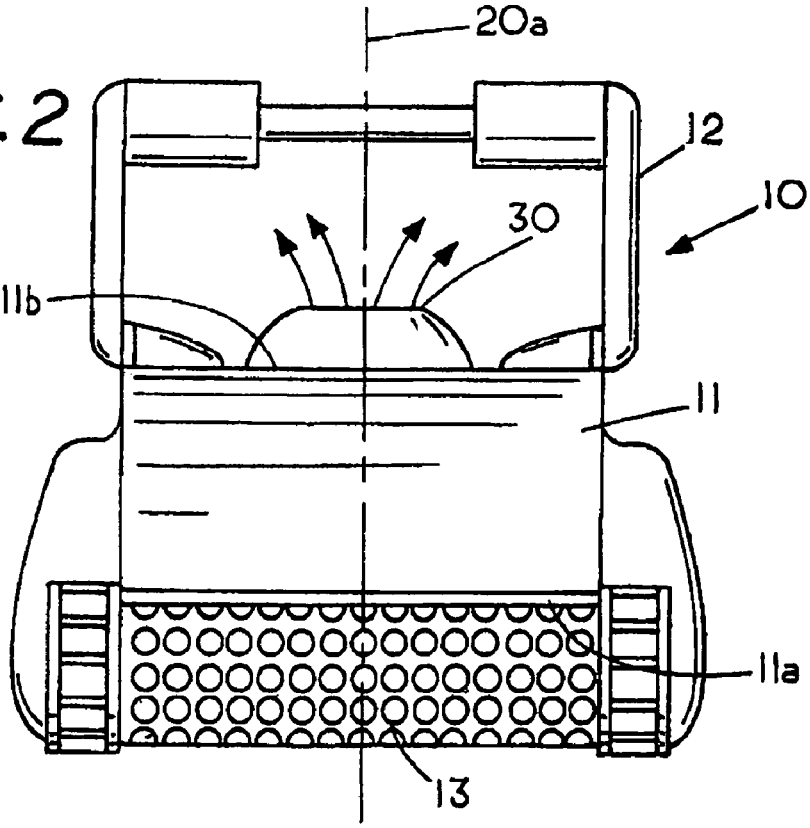
FIG. 2 is a front view of a pool cleaner of FIG. 1 with a dispensing attachment thereon.

FIG. 2 is a front view of a pool cleaner 10 with a sanitizing dispenser 30 secured to the top of housing 11 and directly over the discharge vent in the pool cleaner 10 so that clean water from the interior of the pool cleaner 10 is forced to go through dispenser 30 before being discharged into the swimming pool. FIG. 2 shows the dispenser 30 centrally mounted on the pool cleaner 10 so as to maintain the balance of the pool cleaner and therefore not interfere with the cleaning ability of the pool cleaner. That is, the weight distribution of the dispenser 30 is centrally balanced and distributed with respect to a vertical plane 20*a* extending through the center of gravity of the pool cleaner 10 to thereby inhibit or prevent unequal downward forces on the pool cleaner 10 as the pool cleaner traverses the bottom of the pool. If desired one can mount and maintain the dispenser in a static balance with the housing to minimize any alteration of the pressure distribution of the pool cleaner on the surface to be cleaned and thereby allow one to retain the original operating characteristics of the pool cleaner.

FIG. 2 shows a pool cleaner 10 having a housing 11 with an inlet 11*a* for pool water and an outlet 11*b* for clean water and a dispenser 30 containing a dispensable material with dispenser 30 mounted external to the pool cleaner 20. In order to maintain the static balance of the pool cleaner the center of gravity of dispenser is 30 mounted in a vertical plane 20*a* thorough a center of gravity of the pool cleaner 30.

While FIG. 2 shows the dispenser housing 11 mounting directly over the output ports of the pool cleaner 20 the dispenser 30 could be spaced from the outlet and yet remain partially in the flow path of water being discharged. A spacing between the dispenser and the housing would allow a portion of the clean water being discharged from the pool cleaner to pass through the dispenser 30 and a further portion to by pass the dispenser 30.

Figure 3:
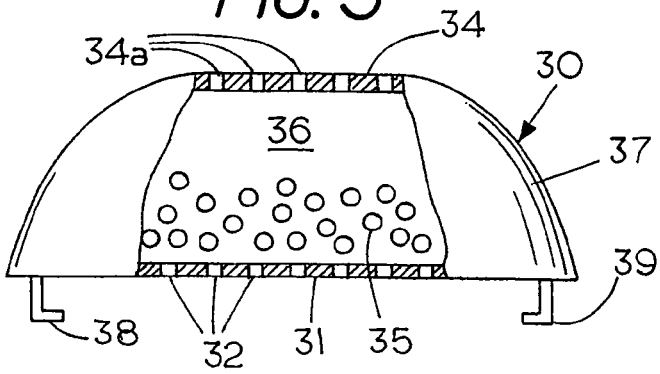
FIG. 3 is a partial sectional view of a dispenser attachment of FIG. 2.

FIG. 3 is a partial sectional view of a dispenser 30 for attachment to a pool cleaner. Dispenser 30 includes a lower support member 31 having a plurality of openings 32 therein to enable dispensable material 35 to be supported thereon without falling through the openings. That is, the size of the openings 32 are such that water can flow therethrough but the dispensable material therein cannot fall through the openings 32. A top dispenser retainer or support member 34 has a set of similar openings 34*a* therein that are sized to allow water to flow through the dispensable material 35, which is located in chamber 36, while at the same time retaining the dispensable material 35 therein.

Located on the lower portion of housing 37 is a first L-shaped resilient latch 38 and a second L shaped resilient latch 39 that face toward each other to allow one to secure the dispenser 30 to the housing of the pool cleaner by securing the latches under vanes or the like in the discharge fitting of a pool cleaner. While two latches are shown more or less latches could be used to secure the dispenser attachment to the housing. Although resilient latches are shown as an example of a fastener that allows one to removeably mount the dispenser 30 over a discharge vent of pool cleaner other types of fasteners could be used such as threads, snaps or the like.

The dispensable material 35, which is located in chamber 36 in dispenser 30 can contain sanitizing or bacteria killing material or other materials such as water conditioning materials, for example calcium carbonate, water softeners, fragrances, etc. If desired vertical extending flow vanes or dividers can be extended from the bottom support 31 of dispenser 30 to maintain the dispensable material 35 in a uniform distribution across the bottom of the support member 31.

Figure 4:
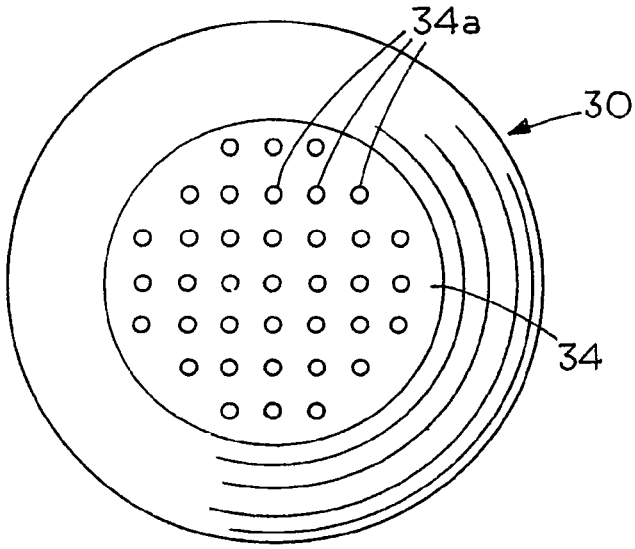
FIG. 4 is a top view of the dispenser attachment of FIG. 2.

FIG. 4 is a top view of the dispenser 30 of FIG. 3 revealing the top support 34 with the plurality of openings 34*a* having a dimension smaller than the dispensable material 35 to retain the dispensable materials. Typically, solid sanitizing materials such as minerals sold by King Technology Inc. of Hopkins Minn. can be placed in the chamber 36.

Figure 5:
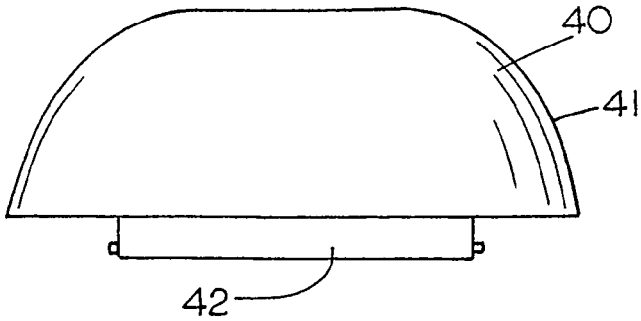
FIG. 5 is a side view of a dispenser of FIG. 2 having an integral outlet fitting for securing to the housing of the pool cleaner.

FIG. 5 is a side view of a dispenser 40 having a housing 41 with an integral outlet fitting 42 therein for replacement of the outlet fitting 14 shown in the pool cleaner 10 of FIG. 1. In this embodiment one removes the outlet fitting 14 with the discharge ports therein from housing 11 and places the cylindrical mount 42 into the opening occupied by the cylindrical fitting 14. One then secures the mount 42 to the housing 11 so that mount 42 has now become a part of the pool cleaner. In this embodiment the dispenser 40 can be secured to the housing 11 in the same manner that the fitting 14 was secured thereto.

Figure 6:
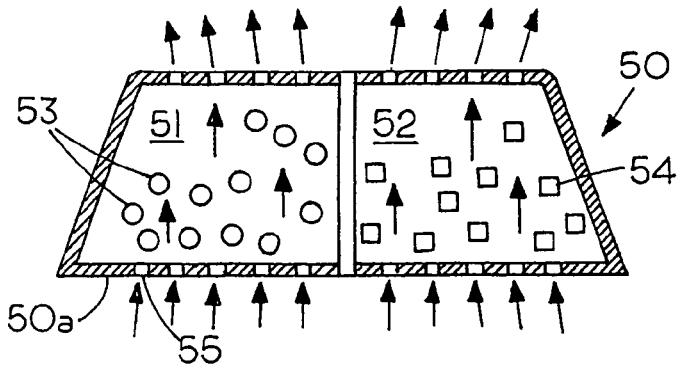
FIG. 6 is a cross section view of a dispenser attachment comprising a two-chamber dispenser.
Figure 7:
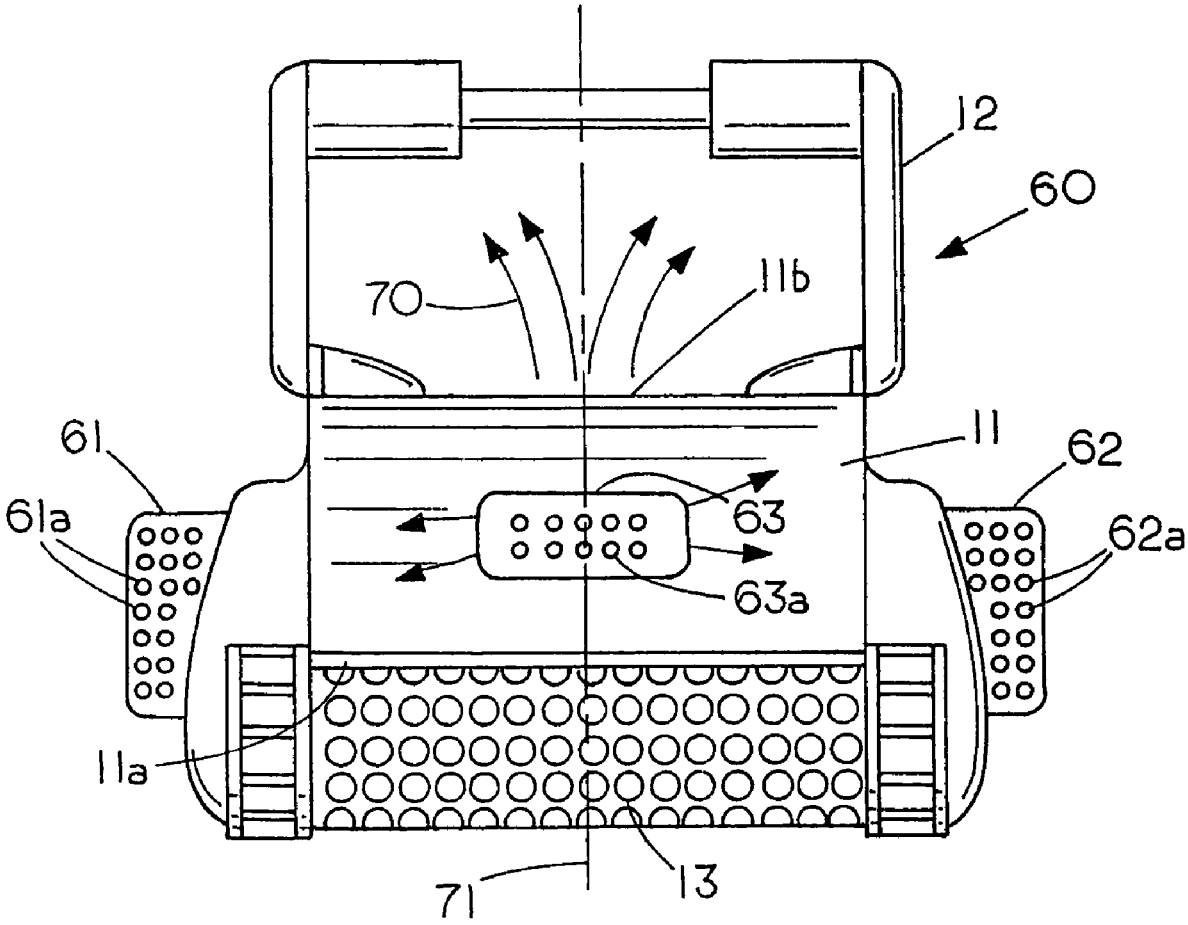
FIG. 7 is a front view of a pool cleaner having a set of side-mounted dispenser attachments and a front mounted dispenser attachment.

FIG. 6 is a cross section view of a two-chamber dispenser 50 having a first chamber 51 for a first dispensable material 53 and a second chamber 52 for a second dispensable material 54. As indicated by arrows the water flows upward through the two chambers 51, 52 to simultaneously dispense material from each dispensing chamber therein. In the embodiment of FIG. 6 the clean water discharging from the pool cleaner flows through both the dispenser material 53 and the dispenser material 54 as it discharges from the pool cleaner when the dispenser 50 is mounted directly over the clean water discharge port in the pool cleaner.

A benefit of the two-chamber dispenser is that one can simultaneously dispense multiple sanitizing materials such as minerals and halogen to thereby maintain the pool in a sanitized condition while minimizing the level of chlorine or bromine in the water in the pool.

FIG. 7 is a front view of a pool cleaner 60 having a set of side-mounted dispensers 61 and 62. Dispensers 61 and 62 are mounted on opposite sides of the pool cleaner 60 and separate and spaced from the incoming stream of water entering inlet 11*a*. In operation, the roller 13 propels the pool cleaner 60 while at the same time a pump (not shown) draws water into the interior of the pool cleaner 60 with the propelling action pulling the dispensers 61, 62 and 63 through the pool water to cause pool water to flow through the dispensers 61, 62 and 63. Dispenser 61 has a housing with openings 61*a* therein, dispenser 62 has a housing with openings 62*a* therein and dispenser 63 has a housing with openings 63*a*. The openings permit water to flow through the dispensers as the pool cleaner is moved about on the floor of a swimming pool. The positioning of two dispensers on housing on opposite sides maintains the side to side balance of the pool cleaner as well as providing for dispensing materials away from the path of the pool water through the pool cleaner. That is the movement of the pool cleaner 60 through the pool provides causes water to flow over the dispensable materials in the dispenser housings 61 and 62. In this embodiment the flow of water through the interior of the pool cleaner 60 is unaffected by the flow of water through the external mounted dispensers 61 and 62. While a single dispenser 63 is shown mounted in the front of housing 11*a* further dispenser could be mounted on the backside of housing 11 if so desired. In some instances it may be preferred to use a single side dispenser rather than two or more dispensers.

Pool cleaner 60 may include only a front mounted dispenser 63 having a chamber with a dispensable material therein with water entering the dispenser 63 though the openings 63*a* in the dispenser housing. The advantage of placing dispensers on the front and back is that one can maintain the original static and dynamic balance of the pool cleaner. That is the original weight or static balance of the pool cleaner can be maintained although in some instances it may be preferred not to maintain a static balance of the pool cleaner.

Thus, FIG. 7 shows a pool cleaner 60 having a housing 11 with an inlet 11*a* for pool water and an outlet 11*b* for clean pool water and a front dispenser 63 and side dispensers 61 and 62 containing a dispensable material with both side dispensers 61 and 62 and front dispenser 63 mounted external to the pool cleaner 60 and each of them spaced from inlet 11*a* to the pool cleaner to thereby provide for separate streams of pool water through dispenser 61, dispenser 62 and dispenser 63 as well as a separate stream 70 of clean pool water which discharges through outlet 11*b* of the pool cleaner. In order to maintain the static balance of the pool cleaner 60 the dispenser 63 is mounted on a vertical plane 71 on a center of gravity of the pool cleaner 60 while dispensers 61 and 62 are spaced equal distance from the vertical plane 71.

As FIG. 7 show the invention may include the combination of a pool cleaner with at least two dispensers mounted on opposite sides of the housing and spaced away from the inlet and the outlet to provide for separate streams of pool water through each of the dispensers while the spacing of the dispensers on opposite sides from each other and along a vertical plane through a center of gravity of the pool cleaner can maintain an original weight balance of the pool cleaner. Similarly, centering the dispensers along a horizontal plane through the center of gravity of the pool cleaner can further assist in maintaining the original dynamics of the pool cleaner if so desired.

While fasteners such as latches 38 and 39 are shown in FIG. 3 each of the dispensers can be connected to the housing through fasteners that may include an adhesive or a mount that is adhesively secured to the housing 11 of the dispenser.

Since some pool cleaners or dispensers may be sensitive to placing the dispenser in the path of water flowing through the pool cleaner one can mount the dispensers away from the inlets and the outlets so the dispenser does not interfere with the water flowing through the pool cleaner. In addition by weight balancing the dispensers on the housing one can minimize interference with the original weight balance of the pool cleaner. Thus, one can create a symbiotic relationship between a pool cleaner and a sanitizing media that simultaneously provides a two-fold benefit, namely cleaning and sanitizing.

While the apparatus of the invention has been described the invention also includes a method of simultaneous on-the-go cleaning and sanitizing a body of water comprising the steps of: propelling a pool cleaner 60 through a body of pool water and along an underwater pool surface; drawing pool water into the pool cleaner as the pool cleaner is propelled therethrough; removing debris from the pool water as the pool water flows through the pool cleaner; generating a flow of clean water 70 from the pool cleaner; and either discharging the flow of the clean water 70 through a dispensable material located in a dispenser 30 which is exteriorly attached to the pool cleaner 11 as shown in FIG. 2 or discharging the clean water back into the pool water while flowing pool water through the dispensable material in dispensers 61, 62, and 63 by propelling the pool cleaner 60 through the pool water as shown in FIG. 7. If the dispenser 50 of FIG. 6 is used one can discharge the clean water through at least two different dispensable materials located in a side by side condition and external to the pool cleaner.

While FIG. 6 shows the discharging the clean water through a support 50*a* having openings 55 therein that are smaller than the dispensable material 53 to retain the dispensable material in a chamber 51 and the dispensable material 54 to retain the dispensable material 54 in chamber 52 other methods of securing the dispensable material may be used for example a solid dispensable material could be secured directly to the housing without the benefit of a dispenser.

FIG. 2 and FIG. 7 illustrate how one can maintain the dispensable material in static balance with the pool cleaner by aligning a central axis of the pool cleaner and a central axis of a dispenser for holding the dispensable material.

Outlet fitting 14 (FIG. 1) can removed from the pool cleaner and by placing the outlet fitting 42 in the pool cleaner, as shown in FIG. 5, one can allow the dispenser 40 to be secured directly to the exterior of the pool cleaner. By placing the dispenser 30 or 40 with dispensable materials at least partially directly in the path of the clean water being discharged from the pool cleaner one can direct a portion of the clean water through the dispenser and a portion of the clean water around the dispenser. A suitable method for doing so is to place spacers between the dispenser and the housing. As configured one can use the present invention to rid the water of debris while discharging the clean water through the outlet port on the pool cleaner as the pool cleaner propels itself along a surface located in the body of water. While the invention is shown in use with a pool cleaner that does not contain an internal sanitizing media the invention can also be used with pool cleaners that contain internal sanitizing media to enhance the delivery of one or more dispensable materials into the pool water.

With the use of the present invention both sanitizing and non-sanitizing materials can be dispersed into the body of water while the pool is being cleaned. As the result if silver ions are dispensed therein the silver ions would be dispensed in a ppb level allowing low levels of chorine i.e. 0.5-1.0 ppm for proper sanitization of pools.

I claim:

1. A dispenser for direct external mounting to an underwater mobile pool cleaner to provide simultaneous cleaning and sanitizing pool water comprising:

a housing, said housing symmetrical to provide for a static balance mount to the pool cleaner, said housing having at least one surface for surface-to-surface mounting to an external surface of a pool cleaner, said housing having a dispensing chamber therein with the housing having an inlet and an outlet with either the housing inlet positionable to impinge on a flow of clean water discharging from the pool cleaner or the housing inlet spaced from the flow of clean water discharging from the pool cleaner water so as to cause a flow of pool water through the housing as consequence of a movement of the pool cleaner through the water;

a first compartment located in said housing, said first compartment containing a first dispensable sanitizing material;

a second compartment containing a second dispensable material located in the housing, said first compartment and said second compartment providing simultaneous dispensing of at least two dispensable materials into water flowing through the dispenser; and a fastener for maintaining the housing on the external surface of the pool cleaner as the pool cleaner moves through the water.

2. The dispenser of claim 1 wherein the fastener comprises resilient latches for securing the housing to a pool cleaner housing.

3. The dispenser of claim 1 wherein the inlet comprises a set of openings to allow ingress of water into the dispensable material and the outlet comprises a set of openings to allow flow of water therethrough wherein a flow area of the openings in the outlet is greater than a flow area of the openings in the inlet.

4. The dispenser of claim 1 wherein the dispenser is located on a side of the pool cleaner so as not to interfere with the flow of water to and from the pool cleaner.

5. A dispenser for direct external mounting to an underwater mobile pool cleaner to provide simultaneous cleaning and sanitizing pool water comprising:

a housing, said housing having at least one surface for surface-to-surface mounting to an external surface of the pool cleaner, said housing having a dispensing chamber therein with the housing having an inlet and an outlet with either the housing inlet positionable to impinge on a flow of clean water discharging from the pool cleaner or the housing inlet spaced from the flow of clean water discharging from the pool cleaner water so as to cause a flow of pool water through the housing as consequence of a movement of the pool cleaner through the water;

a dispensable material located in said chamber;

a fastener for maintaining the housing on the external surface of the pool cleaner as the pool cleaner moves through the water; and at least two dispensers each mounted on opposite sides of the pool cleaner to dispense materials into the water.

6. A method of simultaneous on-the-go cleaning and sanitizing a body of water comprising the steps of:

propelling a pool cleaner through a body of water and along an underwater pool surface;

drawing pool water into the pool cleaner as the pool cleaner is propelled;

removing debris from the pool water as the pool water flows through the pool cleaner;

generating a flow of clean water from the pool cleaner; and either discharging the clean water through at least two different dispensable materials located external to the pool cleaner or discharging the clean water back into the pool water while flowing pool water though the dispensable materials by propelling the pool cleaner through the pool water.

7. The method of claim 6 including the step of discharging the clean water through a support having openings therein that are smaller than the dispensable material therein to retain the dispensable material in a chamber in the dispenser secured to the pool cleaner.

8. The method of claim 6 including the step of removing the dispenser from the pool cleaner and replacing the dispenser with a charge of fresh dispensable material without opening the pool cleaner.

9. The method of claim 6 including maintaining the dispensable material in static balance with the pool cleaner by aligning a central axis of the pool cleaner and a central axis of a dispenser for holding the dispensable material.

10. A method of simultaneous on-the-go cleaning and sanitizing a body of water comprising the steps of:

removing an outlet fitting from a pool cleaner and replacing the outlet fitting with a dispenser having an outlet fitting securable thereto to allow the dispenser to be secured directly to the exterior of the pool cleaner;

propelling the pool cleaner through a body of water and along an underwater pool surface drawing pool water into the pool cleaner as the pool cleaner is propelled;

removing debris from the pool water as the pool water flows through the pool cleaner;

generating a flow of clean water from the pool cleaner; and either discharging the flow of the clean water through a dispensable material exteriorly attached to the pool cleaner or discharging the clean water back into the pool water while flowing pool water through the dispensable material by propelling the pool cleaner through the pool water.

11. A method of simultaneous on-the-go cleaning and sanitizing a body of water comprising the steps of:

propelling a pool cleaner through a body of water and along an underwater pool surface;

drawing pool water into the pool cleaner as the pool cleaner is propelled;

removing debris from the pool water as the pool water flows through the pool cleaner;

generating a flow of clean water from the pool cleaner;

placing a dispenser with a dispensable material at least partially directly in the path of the clean water being discharged from the pool cleaner; and either discharging the flow of the clean water through the dispensable material exteriorly attached to the pool cleaner or discharging the clean water back into the pool water while flowing pool water through the dispensable material by propelling the pool cleaner through the pool water.

12. The method of claim 11 including riding the water of debris and discharging the clean water through the outlet port on the pool cleaner as the pool cleaner propels itself along a surface located in the body of water.

13. The method of claim 11 including directing a stream of pool water through the dispensable material through propelling of the pool cleaner through the water.

14. A pool cleaner having a housing with an inlet for pool water and an outlet for clean water;

a dispensable material mounted external to the pool cleaner and spaced away from an inlet and an outlet to the pool cleaner to thereby provide for a separate stream of pool water over the dispensable material and a separate stream of pool water through the pool cleaner; and at least two dispensers mounted on the housing and spaced away from the inlet and the outlet to provide for separate streams through each of the dispensers with the dispensers spaced from each other to maintain an original weight balance of the pool cleaner.

15. The pool cleaner of claim 14 wherein a dispenser is removably mounted to the side of the pool cleaner.

16. The pool cleaner of claim 14 wherein the dispensable material is mounted on a vertical plane through a center of gravity of the pool cleaner.

* * * * *